United States Patent [19]

Martin et al.

[11] Patent Number: 4,854,570

[45] Date of Patent: Aug. 8, 1989

[54] SHEET FEEDING SYSTEM

[75] Inventors: Harvey G. Martin, West Sussex; Roger Pilling; Steven M. Hosking, both of Hampshire, all of England

[73] Assignee: De La Rue Systems, Ltd., England

[21] Appl. No.: 106,239

[22] Filed: Oct. 7, 1987

[30] Foreign Application Priority Data

Oct. 8, 1986 [GB] United Kingdom ..... 8624192
Jan. 13, 1987 [GB] United Kingdom ..... 8700704

[51] Int. Cl.[4] ..... B65H 1/00

[52] U.S. Cl. ..... 271/162; 271/181; 271/207; 221/154; 221/197; 221/198; 221/287; 109/47; 109/59 R; 109/64; 109/52; 902/13

[58] Field of Search ..... 271/163, 162, 145, 177, 271/180, 181, 207, 184; 221/154, 197, 198, 287; 209/534; 109/47, 59 R, 63.5, 64, 50–52, 66, 45; 232/44, 12, 1 D, 6, 43.2; 902/13

[56] References Cited

U.S. PATENT DOCUMENTS

| | | | |
|---|---|---|---|
| 4,189,139 | 2/1980 | Uchida et al. | 271/162 |
| 4,529,118 | 7/1985 | Granzow et al. | 232/43.3 |
| 4,529,119 | 7/1985 | Granzow et al. | 109/50 X |
| 4,552,075 | 11/1985 | Glasson et al. | 109/59 R |
| 4,570,548 | 2/1986 | Martin et al. | 221/197 X |

FOREIGN PATENT DOCUMENTS 658736 2/1986 Switzerland .

*Primary Examiner*—Joseph J. Rolla
*Assistant Examiner*—David H. Bollinger
*Attorney, Agent, or Firm*—Ostrolenk, Faber, Gerb & Soffen

[57] ABSTRACT

A sheet feeding system comprises an interlock assembly for use with a sheet store which includes, a carriage slidably mounted in a housing. A disc shaped locking member locks the carriage in a first position relatively to the housing. A probe can be inserted into the carriage to move a spring biassed plunger out of engagement with the disc to allow the disc to move into an aperture in the probe in order to lock the probe with the carriage for movement relative to the housing.

8 Claims, 2 Drawing Sheets

Fig. 1A.
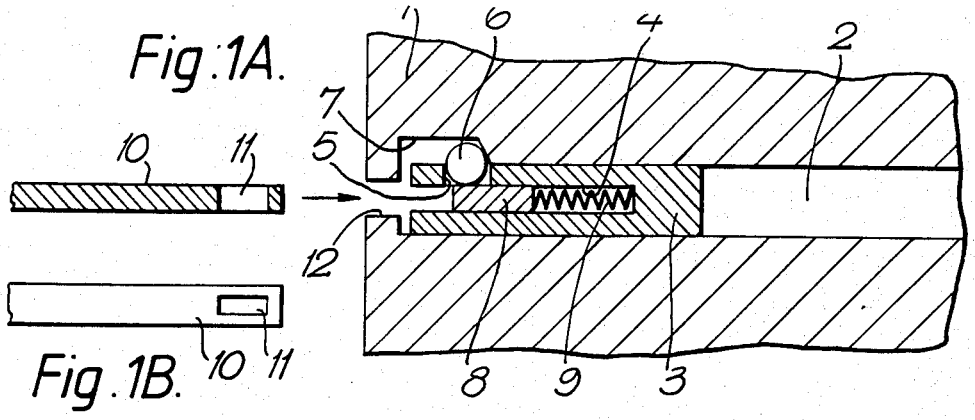
Fig. 1B.
Fig. 2.
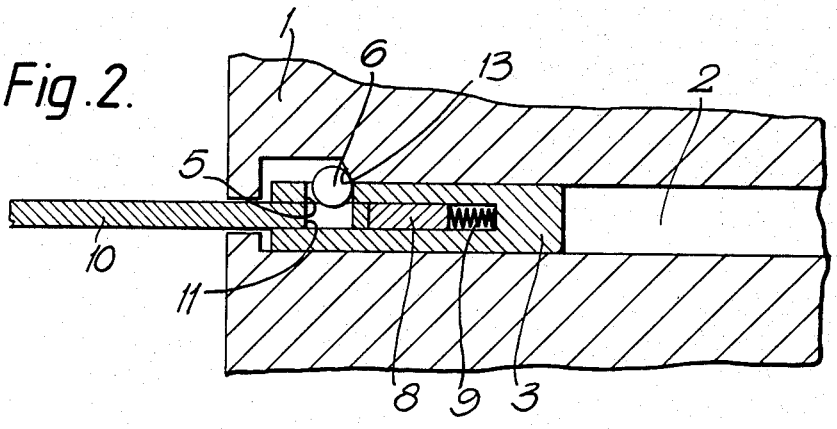
Fig. 3.
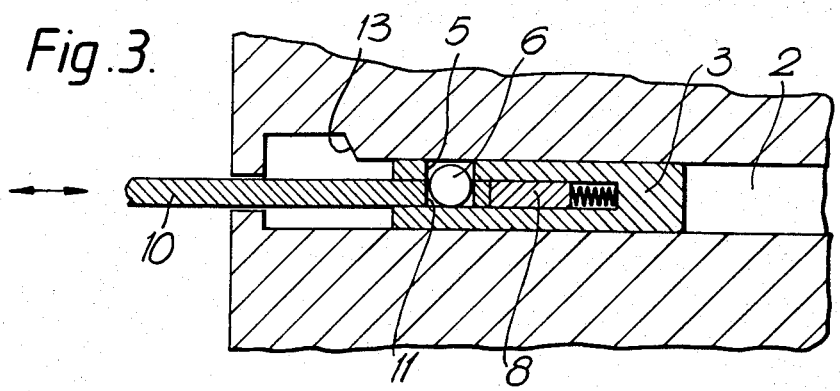

SHEET FEEDING SYSTEM

FIELD OF THE INVENTION

The invention relates to systems for feeding sheets.

DESCRIPTION OF THE PRIOR ART

In the field of sheet dispensers and sheet acceptors, it is common to provide sheet cassettes which automatically open when they are inserted into the sheet dispensing or sheet accepting apparatus. This is particularly important in the case of sheet dispensers where a cassette will be prefilled with sheets prior to insertion in the dispenser. It is known to provide a cassette which is automatically opened upon insertion into a supporting housing of for example a sheet dispenser or sheet acceptor but these automatic opening arrangements tend to be complex and liable to jam or otherwise malfunction.

SUMMARY OF THE INVENTION

In accordance with a first aspect of the present invention, a sheet store comprises a housing on which is movably mounted a first interlock member; locking means for locking the first interlock member against movement relatively to the housing; an aperture through which sheets may be passed, and a shutter for closing the aperture, the shutter being coupled with the first interlock member whereby when the first interlock member is locked to the housing the shutter is in a closed position; and whereby upon relative movement in a first direction between the sheet store and a second interlock member, the second interlock member causes the locking means to unlock the first interlock member from the housing and to be locked to the second interlock member for movement therewith in the first direction relatively to the housing, the shutter moving to an open position when the first interlock member is moved relatively to the housing, in the first direction, by the second interlock member.

In accordance with a second aspect of the present invention, a sheet feeding system comprises a sheet store including a housing on which is movably mounted a first interlock member, the sheet store including locking means for locking the first interlock member against movement relatively to the housing; a sheet store support including sheet feeding means for passing sheets through an aperture in the sheet store when it is mounted in the support, the sheet store support including a second interlock member which, upon relative movement in a first direction between the sheet store and the second interlock member, cooperates with the locking means to unlock the first interlock member from the housing and to be locked to the first interlock member for movement therewith in the first direction relatively to the housing, wherein the sheet store has a shutter for closing the aperture, the shutter being coupled with the first interlock member whereby when the first interlock member is locked to the housing the shutter is in a closed position, the shutter moving to an open position when the first interlock member is moved in the first direction relatively to the housing by the second interlock member.

This invention provides a very simple sheet store and sheet feeding assembly in which the second interlock member not only unlocks the first interlock member from the housing but also becomes locked to the first interlock member for movement therewith upon simple relative movement between the housing and the second interlock member.

It is also particularly preferable if reverse relative movement between the housing and the second interlock member causes the second interlock member to be unlocked from the first interlock member and the first interlock member to be locked thereafter to the housing.

A further significant advantage of this invention is that the locking of the first and second members together and the subsequent unlocking occurs automatically in a single smooth movement. The chances of jamming or malfunction are thus considerably reduced over previously known arrangements.

Preferably, the first interlock member is slidably mounted in the housing.

It is particularly convenient if the locking means also locks the first and second interlock members together. The locking means may comprise a lock member movable between a first position in which it engages and locks the first interlock member to the housing, and a second position in which it engages and locks the first and second interlock members together while allowing the interlock members to move relatively to the housing. Preferably, the lock member is biased towards the first position although in other arrangements, it could be biased towards the second position.

Conveniently, the first interlock member has an opening into which the lock member protrudes in its first position so as to engage the first interlock member, the lock member being displaceable through the opening out of engagement with the housing and into engagement with the first and second interlock members in its second position. To achieve this, the second interlock member may have an aperture or other recess which cooperates with the aperture in the first interlock member to enable the lock member to pass through the first interlock member aperture and to be received, in its second position, in the apertures in both the first and second interlock members.

Preferably, the locking means includes a closure member which is movable between first and second positions in cooperation with the second interlock member, the closure member being adapted in its first position to prevent the lock member passing through the first interlock member aperture and in its second position permitting such movement whereupon the lock member extends into the apertures in the first and second interlock members.

The closure member is preferably slidably mounted in the first interlock member in a bore having a side wall in which the first interlock member aperture is positioned.

BRIEF DESCRIPTION OF THE DRAWINGS

In order that the invention may be better understood, an embodiment of a sheet accepting system according to the invention will now be described with reference to the accompanying drawings, in which:

FIG. 1A is a schematic view of the interlock members and the locking means prior to insertion of the second interlock member into the housing;

FIG. 1B is a plan of part of the second interlock member;

FIGS. 2 and 3 illustrate schematically the interlock members and the locking means in two different positions in which the first and second interlock members engage one another, and, FIG. 4 illustrates schematically a sheet accepting cassette and support incorporating the interlock members and the locking means.

DETAILED DESCRIPTION OF AN EMBODIMENT

Figure 4:
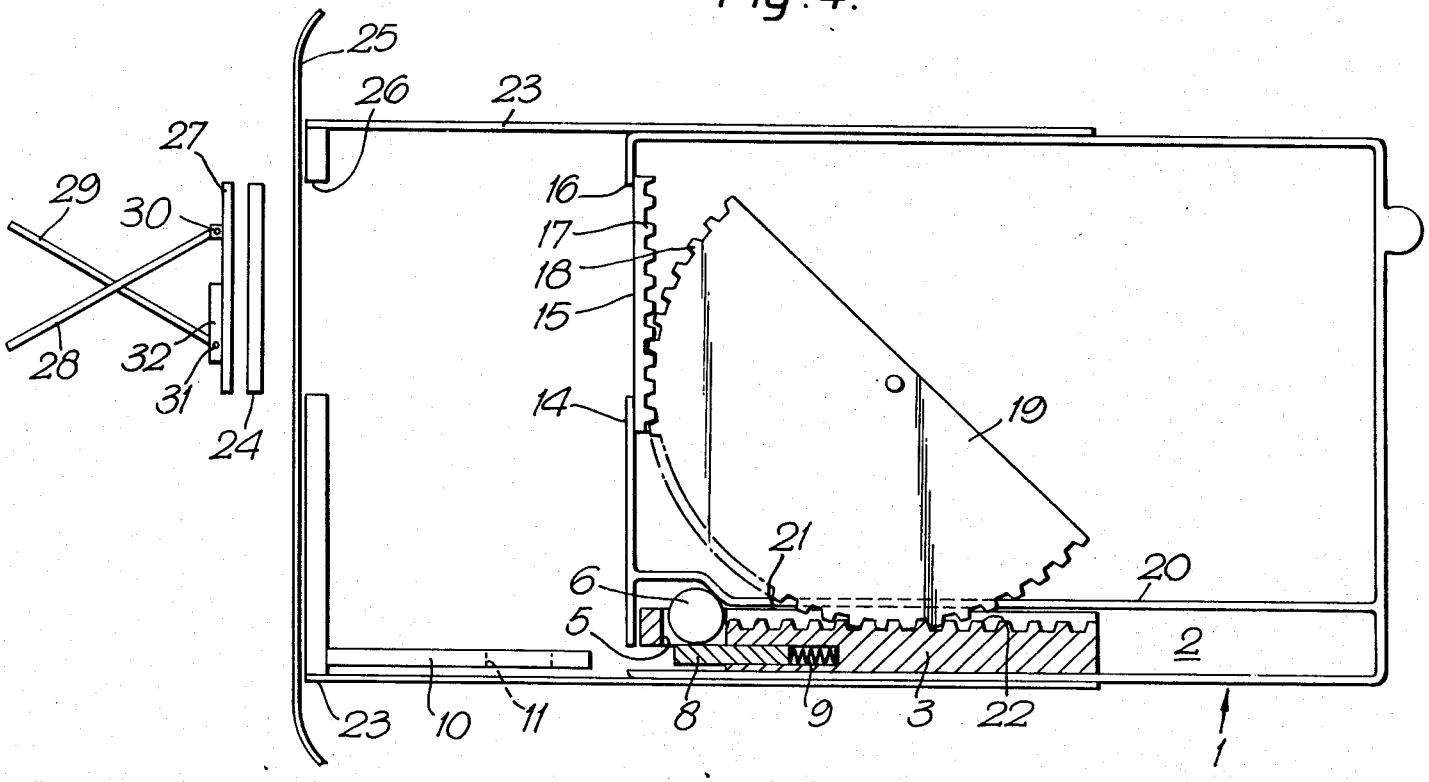

The assembly shown in the drawings comprises a housing 1 which forms part of a sheet cassette and in which is provided a slideway 2 in which is mounted a carriage 3 constituting a first interlock member. The carriage 3 has a blind bore 4 and an aperture 5 passing through a wall of the bore 4. The carriage 3 is coupled to a shutter of the cassette to be described below so that movement of the carriage 3 towards and away from the FIG. 1A position along the slideway 2 causes the shutter to close and open respectively.

The carriage 3 is locked in the position shown in FIG. 1A by a disc 6 which is received in a recess 7 of the slideway 2 and protrudes into the aperture 5 of the carriage 3. The disc 6 is prevented from passing through the aperture 5 by a plunger 8 slidably mounted in the bore 4 and biased towards the position shown in FIG. 1A by a compression spring 9. The carriage 3 is prevented from moving to the left in FIG. 1A by part of the wall of the housing 1.

A second interlock member defined by a probe 10 is provided which, in use, is mounted in a fixed position on the sheet acceptor (FIG. 4). The probe 10 has an aperture 11 in its leading end.

When the cassette is loaded into the sheet acceptor, the probe 10 enters an aperture 12 in the housing 1 aligned with the slideway 2. The aperture 12 and probe 10 can be designed to have any convenient cooperating shape so as to restrict the number of types of probe which can be inserted. The probe 10 enters into the slot 4 of the carriage 3 in a first direction and pushes the plunger 8 further into the slot against the force of the spring 9. This movement brings the aperture 11 in the probe 10 into alignment with the aperture 5 in the carriage 3 as shown in FIG. 2. Further movement of the housing 1 relative to the probe 10 in the first direction causes the probe to push the carriage 3 along the slideway 2. This movement of the carriage 3 acts on the disc 6 which cooperates with a cam face 13 on the housing 1 and the wall of the aperture 5 to move into the apertures 5, 11 thus locking the probe 10 and the carriage 3 together. Thereafter, as shown in FIG. 3, the probe 10 can push the carriage 3 (either directly or via movement of the housing 1 relative to the probe) or can pull it via the disc 6.

When the probe 10 is withdrawn upon removal of the housing 1, the carriage 3 and probe 10 are drawn back to the position shown in FIG. 2 and since the probe is below the centre line of the disc 6, further movement of the probe 10, to the left in FIG. 2, enables the disc 6 to ride the tip of the probe and so become squeezed out of its trapped position to resume the position shown in FIG. 1A. The plunger 8 follows the tip of the probe, under the influence of the spring 9, to regain its former position as shown in FIG. 1A. In this situation, the carriage 3 is again locked to the housing 1.

It will be seen that coupling and uncoupling of the probe 10 and carriage 3 is automatic and occurs in a continuous motion.

FIG. 4 illustrates part of a sheet feeding system for inserting sheets 24 into a sheet accepting cassette 14. The sheet accepting cassette 14 is inserted into a cassette support 23 having a probe 10. The probe 10 engages with a carriage 3 within the housing 1 of the cassette 14, as the cassette 14 is inserted into the cassette support 23.

The cassette 14 has a shutter 15 slidably mounted so as to close an access aperture 16 in the cassette wall. The shutter 15 has a toothed rack portion 17, which engages the toothed periphery 18 of a pivoted semi-circular control member 19. Part of the cassette 14 defines the housing 1 of an interlock assembly shown in FIGS. 1 to 3 and a wall 20 having an aperture 21 through which the pivoted member 19 protrudes. The carriage 3 has a toothed portion 22 which engages the periphery of the member 19.

It will be seen in FIG. 4 that movement of the carriage 3 in the slideway 2 causes the control member 19 to pivot in an anti-clockwise direction thus opening the shutter 15. Reverse movement of the carriage 3, as the cassette 14 is extracted from the cassette support 23, will cause the shutter 15 to close the aperture 16.

The sheet feed system also includes a pair of belts 25 (only one shown) which are spaced apart in front of the aperture 26 in the cassette support 23, and a moveable pad 27 (shown schematically in FIG. 4). The pad 27 may be passed between the belts 25 by a scissor like movement of the two arms 28, 29 attached to the rear of the pad 27. Arm 28 is attached to the pad 27 by a fixed pivot point 30. Arm 29 is attached by a pivot point 31 to the pad 27 and the pivot 31 may be moved up or down in the track 32 to enable the arms 28, 29 to be closed or opened. In the diagram of FIG. 4 the arms 28, 29 are open. When they are closed, the pivot 31 moves to the other end of the track 32 and as this happens the pad 27 is moved forwards between the belts 25 towards the aperture 26 in the cassette support 23.

In operation, the cassette 14 is inserted into the cassette support 23 and the probe 10 engages the carriage 3, releasing the disc 6, and thereby pushing the carriage to the rear of the housing 1. This causes control member 19 to rotate and open the shutter 15, so that when the cassette 14 is fully inserted into the cassette support 23 the aperture 16 will be open.

A sheet 24 is then transported by the belts 25 so that it is positioned between the pad 27 and the belts 25, as shown in FIG. 4. The arms 28, 29 are then closed, causing the pad 27 to move forward and press the sheet between the belts 25, through the apertures 26 and 16, and into the cassette 14. The pad 27 is then retracted to its original position by opening the arms 28, 29 in readiness for the next sheet to be inserted into the cassette.

We claim:

1. A sheet feeding system comprising a sheet store including a housing on which is movably mounted a first interlock member, said sheet store including locking means for locking said first interlock member against movement relative to said housing; a sheet store support including sheet feeding means for passing sheets through an aperture in said sheet store when it is mounted in said support, said sheet store support including a second interlock member which, upon relative movement in a first direction between said sheet store and said second interlock member, cooperates with said locking means to unlock said first interlock member from said housing and causes said locking means to lock said first interlock member to said second interlock member for movement therewith in said first direction relative to said housing, said sheet store having a shutter for closing said aperture, said shutter being coupled with said first interlock member in such a manner that when said first interlock member is locked to said housing said shutter is in a closed position, said shutter moving to an open position when said first interlock member is moved in said first direction relative to said housing by said second interlock member and wherein said locking means comprises a lock member movable between a first position in which it engages and locks said first interlock member to said housing, and a second position in which it engages and locks said first and second interlock members together while allowing said first and second interlock members to move relative to said housing; said first interlock member having an aperture into which said lock member protrudes in its first position so as to engage said first interlock member, said lock member being displaceable through said aperture out of engagement with said housing and into engagement with said first and second interlock members in its second position.

2. A sheet feeding system according to claim 1, wherein said second interlock member has an aperture which cooperates with said aperture in said first interlock member to enable said lock member to pass through said first interlock member aperture and to be received, in its second position, in said apertures in both said first and second interlock members.

3. A sheet feeding system according to claim 2, wherein said locking means includes a closure member which is movable between first and second positions in cooperation with said second interlock member, said closure member being adapted in its first position to prevent said lock member passing through said first interlock member aperture and in its second position permitting such movement whereupon said lock member extends into said apertures in said first and second interlock members.

4. A sheet store comprising a housing on which is movably mounted a first interlock member, locking means for locking said first interlock member against movement relative to said housing, an aperture through which sheets may be passed, and a shutter for closing said aperture, said shutter being coupled with said first interlock member in such a manner that when said first interlock member is locked to said housing, said shutter is in a closed position; said sheet store having an opening therein through which a second interlock member may be inserted for movement relative to said housing in first and second directions, said second interlock member causing said locking means to unlock said first interlock member from said housing and to lock said first interlock member to said second interlock member for movement therewith in said first direction relative to said housing in response to relative movement in said first direction between said sheet store and said second interlock member, said shutter moving to an open position when said first interlock member is moved relatively to said housing, in said first direction, by said second interlock member, said locking means comprising a lock member movable between a first position in which it engages and locks said first interlock member to said housing, and a second position in which it engages and locks said first and second interlock members together while allowing said first and second interlock members to move relatively to said housing, wherein said first interlock member has an aperture into which said lock member protrudes in its first position so as to engage said first interlock member, said lock member being displaced through said aperture in said first interlock member out of engagement with said housing and into engagement with said first and second interlock members in its second position.

5. A sheet feeding system, comprising:

(A) a sheet feeding store and a sheet store support, said sheet feeding store being insertable into and removable from said sheet store support;

(B) said sheet feeding store including;

(1) a housing for storing sheets; an opening formed in said housing;

(2) a shutter moveable between a closed position wherein it covers said opening and an open position wherein it uncovers said opening;

(3) a first interlock member mounted on said housing and operatively coupled to said shutter and moveable between a first position wherein said shutter is in said closed position and a second position wherein said shutter is in said open position; and (4) locking means for locking said first interlock member in said first position when said store is removed from said support;

(C) said sheet store support including:

(1) support means for supporting said store;

(2) a second interlock member which cooperates with said locking means to unlock said first interlock member from said first position and move said first interlock member into said second position when said store is inserted into said support;

(D) said locking means including a lock member linearly movable between a first position in which it engages and locks said first interlock member to said housing, and a second position in which it engages and locks said first and second interlock members together while allowing said first and second interlock members to move as a unit relative to said housing so that said shutter may be moved to said open position.

6. A sheet feeding system according to claim 5, wherein said second interlock member causes said first interlock member to return to its first position and to be unlocked from said first interlock member and further causes said first interlock member to be locked to said housing when said store is removed from said store support.

7. A sheet feeding system according to claim 6, wherein said first interlock member is slidably mounted in said housing.

8. A sheet feeding system according to claim 5, wherein said first interlock member is slidably mounted in said housing.

* * * * *